US008544365B2

(12) United States Patent
Wang

(10) Patent No.: US 8,544,365 B2
(45) Date of Patent: Oct. 1, 2013

(54) RATCHET TOOL

(76) Inventor: Tzu-Chien Wang, Tainan (TW)

( * ) Notice: Subject to any disclaimer, the term of this patent is extended or adjusted under 35 U.S.C. 154(b) by 238 days.

(21) Appl. No.: 13/136,966

(22) Filed: Aug. 16, 2011

(65) Prior Publication Data

US 2013/0042723 A1 Feb. 21, 2013

(51) Int. Cl.
*B25B 13/46* (2006.01)
*B25B 15/04* (2006.01)

(52) U.S. Cl.
USPC ..... 81/63.1

(58) Field of Classification Search
USPC ..... 81/60–62, 63.1, 436, 438
See application file for complete search history.

(56) References Cited

U.S. PATENT DOCUMENTS 6,658,970 B2 * 12/2003 Shiao ..... 81/62
7,421,772 B2 * 9/2008 Gao et al. ..... 29/434
7,926,390 B2 * 4/2011 Bennett ..... 81/62
7,926,391 B2 * 4/2011 Hu ..... 81/63.1
8,096,214 B2 * 1/2012 Gao ..... 81/475
8,122,791 B2 * 2/2012 Klomp ..... 81/63.1
8,272,298 B2 * 9/2012 Chen ..... 81/63.1
2009/0199683 A1 * 8/2009 Hu ..... 81/63.1
2009/0205467 A1 * 8/2009 Gao ..... 81/63.2
2010/0229694 A1 * 9/2010 Chen ..... 81/63.1
2012/0055290 A1 * 3/2012 Chen ..... 81/63.1
2012/0318104 A1 * 12/2012 Shu ..... 81/63.1

* cited by examiner

*Primary Examiner* — David B Thomas
(74) *Attorney, Agent, or Firm* — William E. Pelton, Esq.; Cooper & Dunham LLP

(57) ABSTRACT

The ratchet tool has a housing, a ratchet mechanism and a locking plate. The housing includes a chamber and multiple locking grooves. The ratchet mechanism is mounted rotatably through the housing. The locking plate is mounted in the chamber of the housing and has multiple wings. The wings correspond to and engage the locking grooves of the housing in order to lock the ratchet mechanism and the housing. Therefore, users can easily assemble and disassemble the ratchet mechanism and the housing by taking out the locking plate when a broken component needs to be repaired or changed.

9 Claims, 7 Drawing Sheets

RATCHET TOOL

BACKGROUND OF THE INVENTION

1. Field of the Invention

The present invention relates to a ratchet tool, especially to a ratchet tool that can be easily and quickly assembled and disassembled.

2. Description of the Prior Arts

Ratchet tools are used to limit fasteners to unidirectional rotation so that the fasteners can be easily tightened or released by driving tools connected to the ratchet tools.

A conventional ratchet tool generally comprises a gear and a clutch assembly received inside a housing. However, the conventional ratchet tool cannot be disassembled so the gear or the clutch assembly cannot be repaired or changed when worn and torn after long time of use. Consequently, the conventional ratchet tool with the broken gear or clutch assembly must be replaced with a new one even if other components of the conventional ratchet are still working.

To overcome the shortcomings, the present invention provides a ratchet tool to mitigate or obviate the aforementioned problems.

SUMMARY OF THE INVENTION

The main object of the present invention is to provide a ratchet tool that can be easily and quickly assembled and disassembled.

The ratchet tool in accordance with the present invention comprises a housing, a ratchet mechanism and a locking plate. The housing includes an annular sidewall, a closed bottom, an open top, a chamber and multiple locking grooves. The annular sidewall has an internal surface. The chamber is defined between the annular sidewall, the closed bottom and the open top. The locking grooves are formed in the internal surface of the annular sidewall and the open top. The ratchet mechanism is mounted through the housing and includes a cylindrical member, a driving stem and a clutch assembly. The cylindrical member is rotatably received in the housing and has a base and a shaft. The base is received in the chamber of the housing. A height of the base is less than a height of the chamber of the housing. The shaft is formed on and protrudes from an upper surface of the base to connect a driving tool. The driving stem is secured to the base of the cylindrical member. The clutch assembly is mounted in the base of the cylindrical member and is adjacent to the driving stem. The locking plate is mounted in the chamber of the housing and has a central hole and multiple wings. A height of the locking plate is less than a difference in height between the chamber of the housing and the base of the cylindrical member of the ratchet mechanism. The central hole is mounted around the shaft of the cylindrical member of the ratchet mechanism. The wings protrude from a periphery of the locking plate and correspond to and engage the locking grooves of the housing in order to lock the ratchet mechanism and the housing. Therefore, users can easily assemble and disassemble the ratchet mechanism and the housing by taking out the locking plate when a broken component needs to be repaired or changed.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
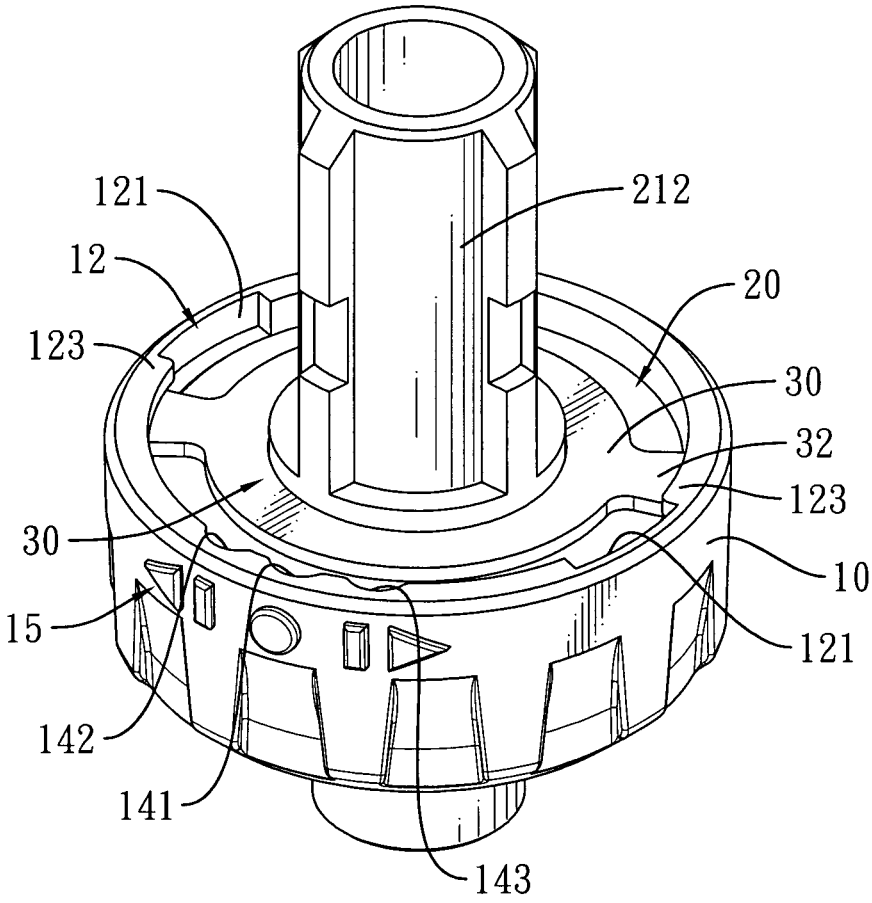
FIG. 1 is a perspective view of a ratchet tool in accordance with the present invention.
Figure 2:
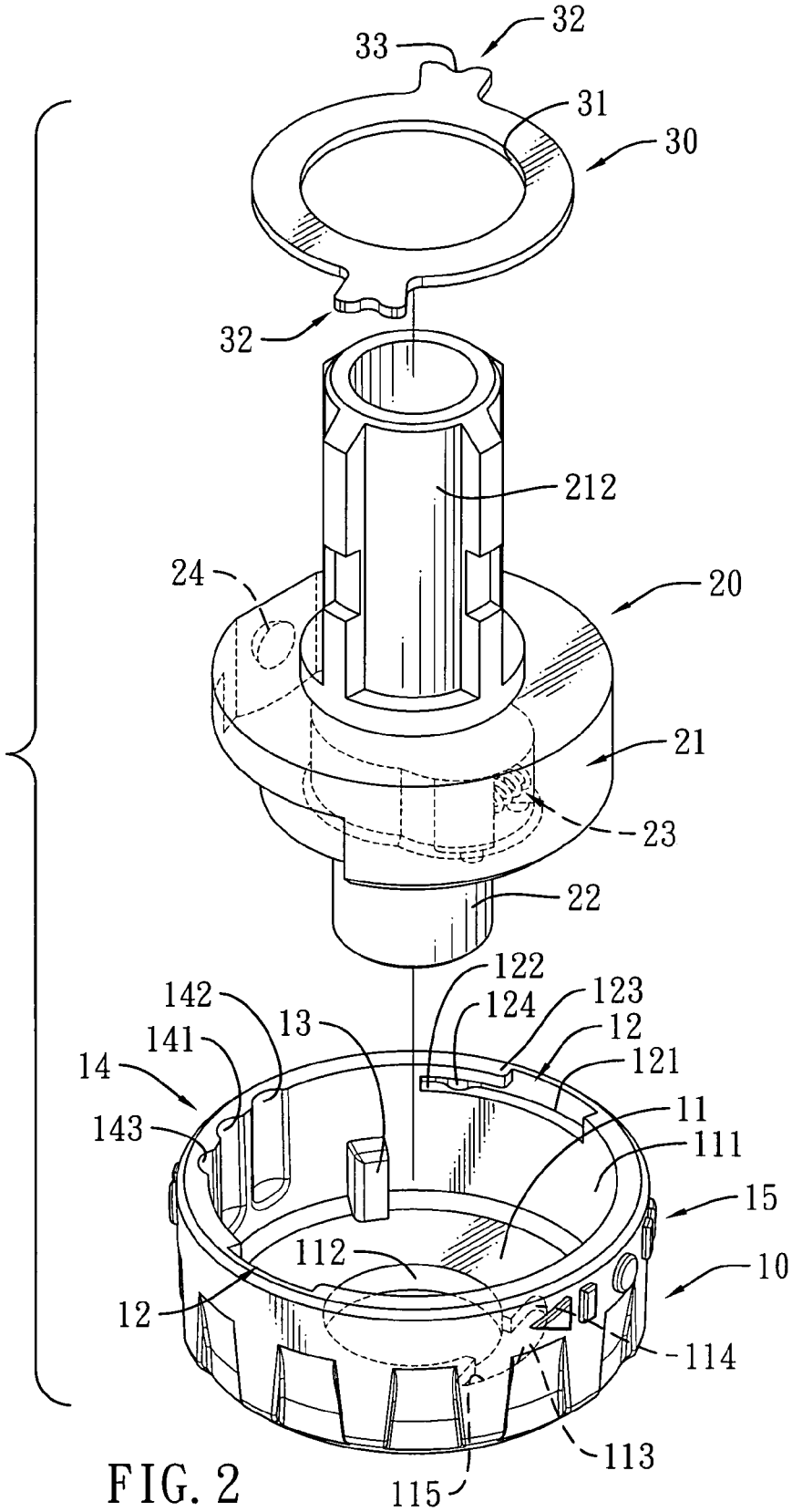
FIG. 2 is a top exploded perspective view of the ratchet tool in FIG. 1.
Figure 3:
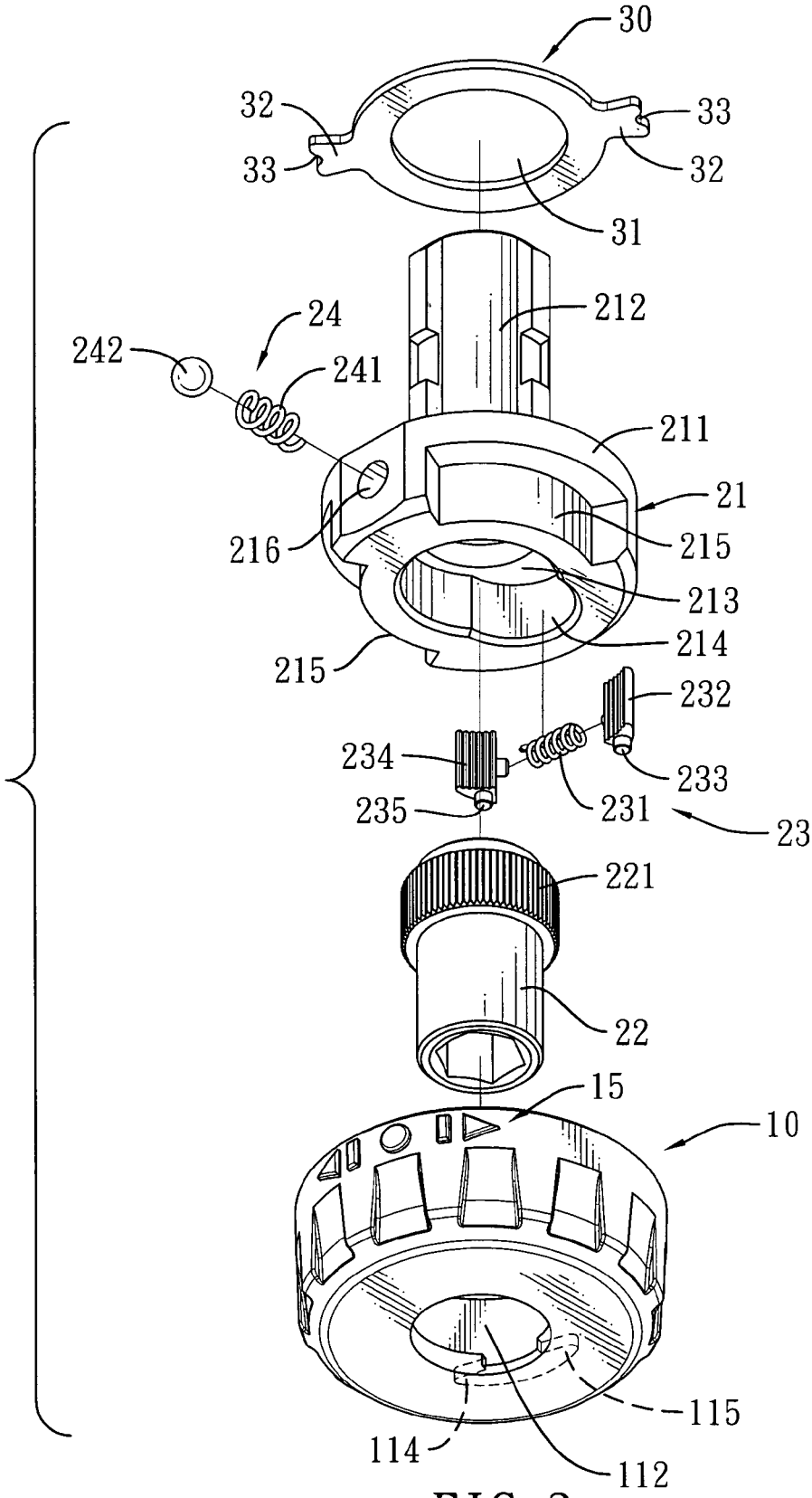
FIG. 3 is a bottom exploded perspective view of the ratchet tool in FIG. 1.

With reference to FIGS. 1 to 4, a ratchet tool in accordance with the present invention comprises a housing 10, a ratchet mechanism 20 and a locking plate 30.

The housing 10 includes an annular sidewall, a closed bottom, an open top 111, a chamber 11, a through hole 112, a guiding space 113, multiple locking grooves 12, two positioning blocks 13, multiple depressions 14 and an indicator 15. The annular sidewall has an internal surface and an external surface. The chamber 11 is defined between the annular sidewall, the closed bottom and the open top 111. The through hole 112 is formed through the closed bottom and communicates with the chamber 11. The guiding space 113 is formed in an upper surface of the closed bottom, communicates with the through hole 112 and has two abutting ends 114,115. The locking grooves 12 are formed in the internal surface of the annular sidewall and the open top 111 and each locking groove 12 has a longitudinal slot 121, a lateral slot 122 and a protrusion 124. The lateral slot 122 extends from a bottom of the longitudinal slot 121 so as to form a barrier segment 123 over the lateral slot 122. The protrusion 124 is curved and convex, is formed on and protrudes from a groove surface of the lateral slot 122. In a preferred embodiment, the housing 10 includes two opposite locking grooves 12. The positioning blocks 13 are formed on and protrude from the internal surface of the annular sidewall. The depressions 14 are formed in the internal surface of the annular sidewall at intervals between the positioning blocks 13 and have open tops. In the preferred embodiment, the housing 10 includes three depressions 141, 142, 143. The indicator 15 is formed on the external surface of the annular sidewall for indicating rotation directions.

The ratchet mechanism 20 is mounted through the housing 10 and includes a cylindrical member 21, a driving stem 22, a clutch assembly 23 and a spring-biased projection 24. The cylindrical member 21 is rotatably received in the housing 10 and has a base 211, a shaft 212, a mounting space 213, a receiving recess 214, two curved grooves 215 and a mounting orifice 216. The base 211 is received in the chamber 11 of the housing 10 and has an upper surface, a lower surface and an external surface. A height of the base 211 is less than a height of the chamber 11 of the housing 10. The shaft 212 is formed on and protrudes from the upper surface of the base 211 to connect a driving tool. The mounting space 213 is formed through the base 211 for receiving the driving stem 22. The receiving recess 214 is formed in the lower surface of the base 211 and communicates with a side of the mounting space 213 for receiving the clutch assembly 23. The curved grooves 215 are formed in the external surface of the base 211 for receiving the positioning blocks 13 of the housing 10. The mounting orifice 216 is formed in the external surface of the base 211 between the curved grooves 215 for receiving the spring-biased projection 24.

The driving stem 22 is secured to the base 211 of the cylindrical member 21, is mounted through the through hole 112 of the housing 10 and has a gear 221 formed thereon and received in the mounting space 213 of the cylindrical member 21. The clutch assembly 23 is mounted in the receiving recess 214 of the cylindrical member 21 and has a pair of pawls 232,234 biased by a compression spring 231 to selectively engage with the gear 221 of the driving stem 22. Each pawl 232,234 has a lever 233,235 protruding from a lower surface of the pawl 232,234 and slidably received in the guiding space 113 of the housing 10. The spring-biased projection 24 is mounted in the mounting orifice 216 of the cylindrical member 21 and has a spring member 241 and a ball 242. The spring member 241 and the ball 242 are mounted in the mounting orifice 216 in sequence. The ball 242 is biased out of the mounting orifice 216 by the spring member 241 to allow the ball 242 to engage one of the depressions 14 of the housing 10.

The locking plate 30 is mounted in the chamber 11 of the housing 10, abuts the base 211 of the cylinder member 21 of the ratchet mechanism 20 and has a central hole 31, multiple wings 32 and multiple catching recesses 33. A height of the locking plate 30 is less than a difference in height between the chamber 11 of the housing 10 and the base 211 of the cylindrical member 21 of the ratchet mechanism 20. The central hole 31 is mounted around the shaft 212 of the cylindrical member 21 of the ratchet mechanism 20. The wings 32 protrude from a periphery of the locking plate 30 and correspond to and are received respectively in the locking grooves 12 of the housing 10. The catching recesses 33 are curved and concave, are formed in edges of the wings 32 respectively and engage the protrusions 124 of the locking grooves 12 of the housing 10 in order to lock the ratchet mechanism 20 and the housing 10. One of the housing 10 and the locking plate 30 is made of soft metal or plastic material.

Figure 4:
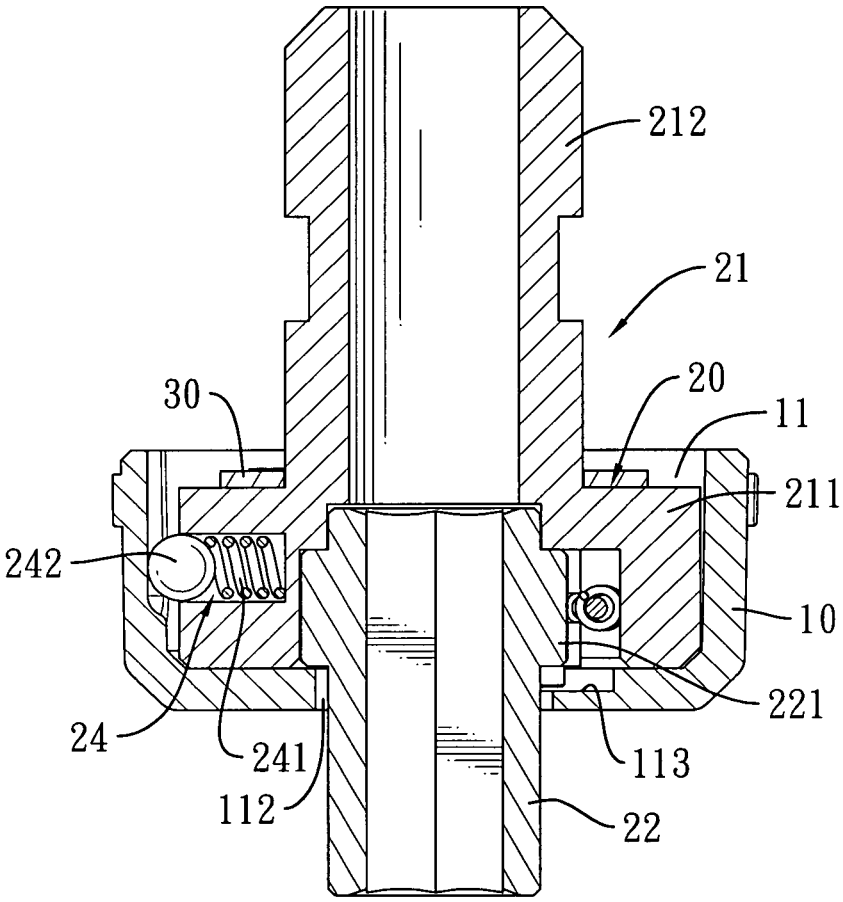
FIG. 4 is a side view in partial section of the ratchet tool in FIG. 1.
Figure 5:
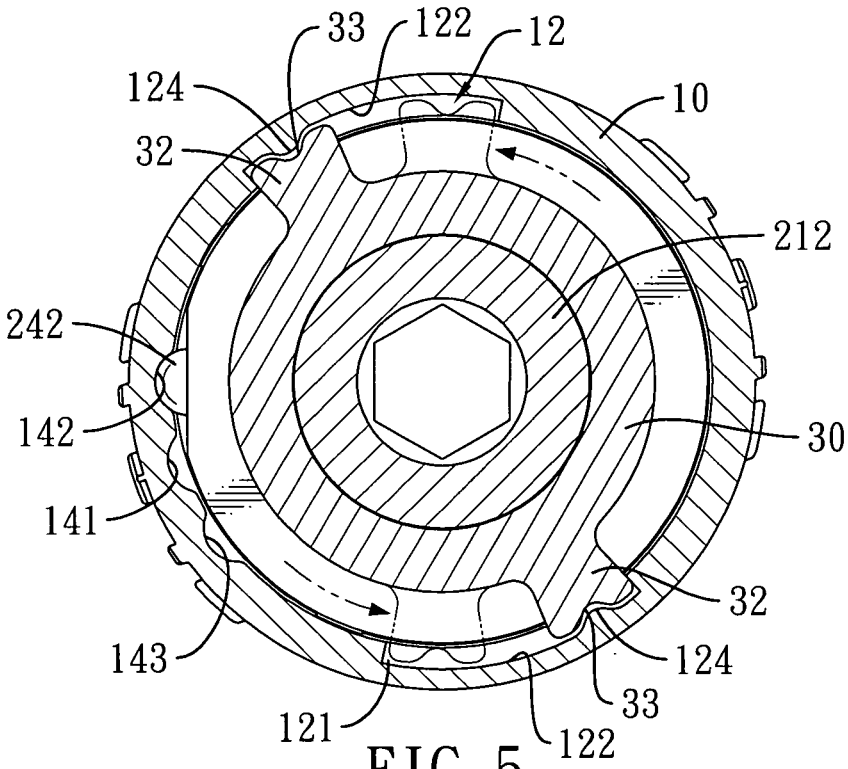
FIG. 5 is an operational cross-sectional top view of the ratchet tool in FIG. 1.
Figure 6:
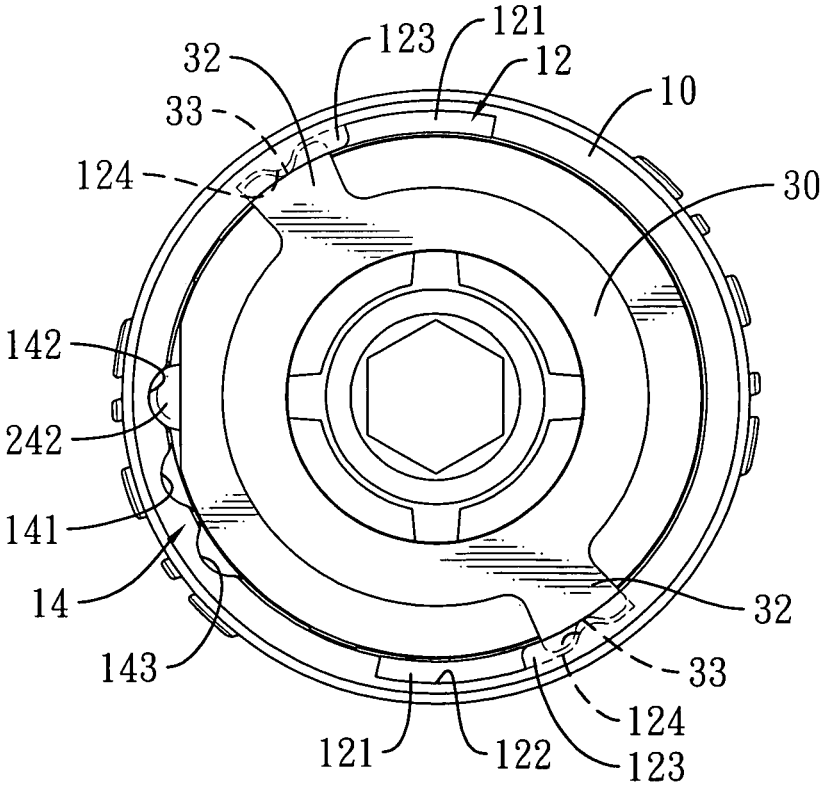
FIG. 6 is a top view of the ratchet tool in FIG. 1.

With reference to FIGS. 4 and 5, when the ratchet tool in accordance with the present invention is operated to be assembled, the ratchet mechanism 20 is inserted into the chamber 11 of the housing 10 to make the driving stem 22 of the ratchet mechanism 20 be mounted through the through hole 112 of the housing 10 and the base 211 of the cylinder member 21 of the ratchet mechanism 20 abut over the closed bottom of the housing 10. The positioning plate 30 is mounted around the shaft 212 of the cylinder member 21 of the ratchet mechanism 20 and the wings 32 of the positioning plate 30 are disposed into the longitudinal slots 121 of the locking grooves 12 of the housing 10. With further reference to FIG. 6, the positioning plate 30 is then rotated relative to the housing 10 and the ratchet mechanism 20 to make the wings 32 of the positioning plate 30 be disposed in the lateral slots 122 under the barrier segment 123 of the locking grooves 12 and the catching recesses 33 of the positioning plate 30 engage the protrusions 124 of the locking grooves 12. Thus, the ratchet tool is assembled. The ratchet tool can be disassembled by performing the foregoing procedures in reverse. The positioning plate 30 is rotated relative to the housing 10 and the ratchet mechanism 20 in reverse to make the wings 32 of the positioning plate 30 be disposed in the longitudinal slots 121 of the locking grooves 12. The positioning plate 30 then can be taken out and the ratchet mechanism 20 can be detached from the housing 10. Consequently, users can quickly and effortlessly assemble and disassemble the ratchet tool when a component needs to be repaired or changed, while other components are still in use.

Figure 7:
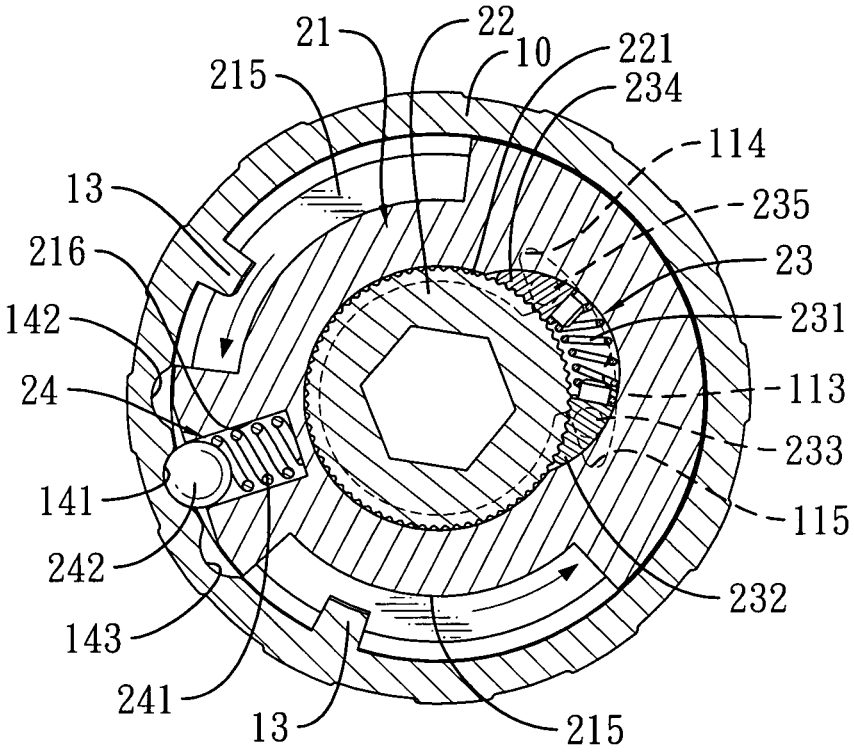
FIGS. 7 to 9 are operational top views in partial section of the ratchet tool in FIG. 1, showing a housing rotated.
Figure 8:
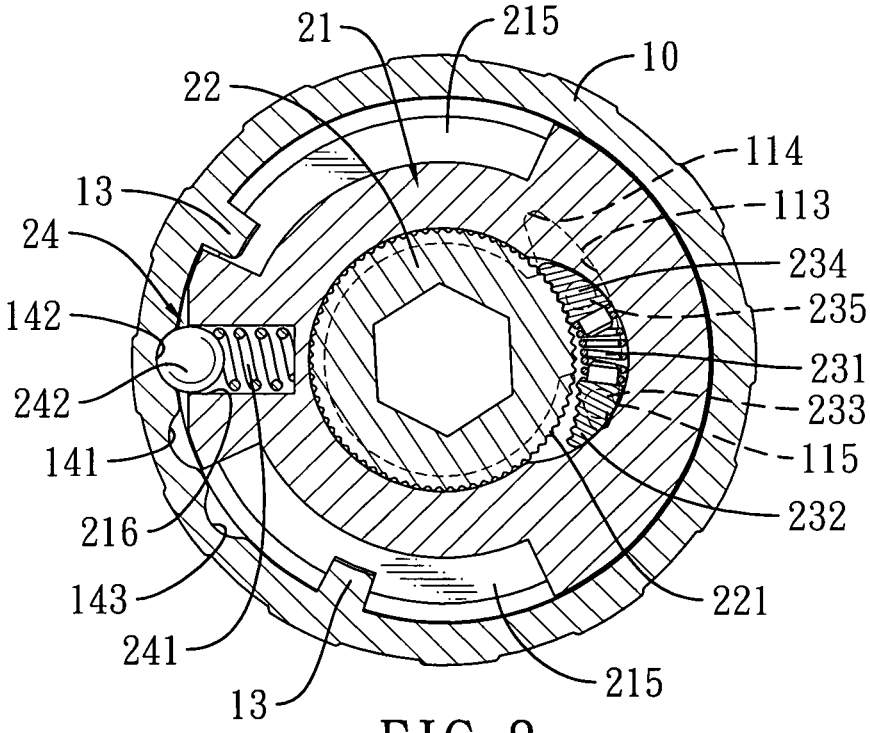
Figure 9:
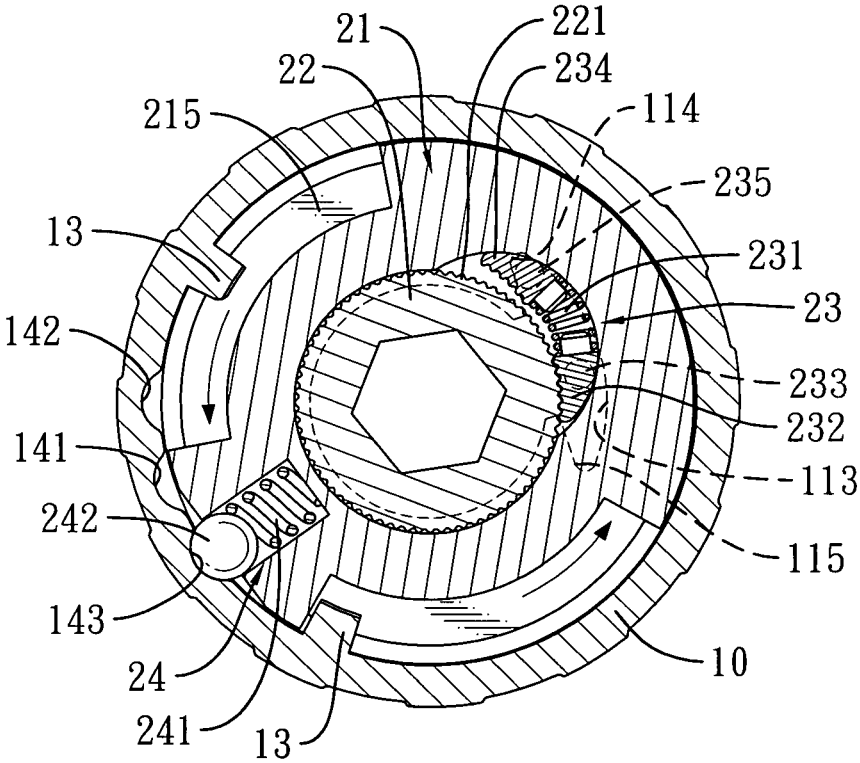

FIGS. 7 to 9 show the ratchet tool in, operation. With reference to FIG. 7, when the ball 242 of the spring-biased projection 24 engages the middle depression 141 of the housing 10, the levers 233,235 of the pawls 232,234 of the clutch assembly 23 are disposed respectively in two opposite sides of the guiding space 113 of the housing 10 and both the two pawls 232,234 engage the gear 221 of the driving stem 22 so that the driving tool connecting the shaft 212 cannot drive the cylindrical member 21 and the driving stem 22 of the ratchet mechanism 20. With reference to FIG. 8, when the housing 10 is rotated to make the ball 242 of the spring-biased projection 24 engage one side depression 142 of the housing 10, the lever 233 of one pawl 232 is driven to abut a corresponding abutting end 115 of the guiding space 113 of the housing 10 to make the pawl 232 disengage from the gear 221 of the driving stem 22 and the lever 234 of the other pawl 234 is driven to be disposed in a middle of the guiding space 113 of the housing 10 to make the pawl 234 engage the gear 221 of the driving stem 22. Under this circumstance, the driving tool can drive the cylindrical member 21 and the driving stem 22 to rotate clockwise because the gear 221 of the driving stem 22 can push the pawl 234 when rotating to make the pawl 234 slip and press the compression spring 231. With reference to FIG. 9, when the housing 10 is rotated to make the ball 242 of the spring-biased projection 24 engage the other side depression 143 of the housing 10, the lever 235 of one pawl 234 is driven to abut a corresponding abutting end 114 of the guiding space 113 of the housing 10 to make the pawl 234 disengage from the gear 221 of the driving stem 22 and the lever 233 of the other pawl 232 is driven to be disposed in a middle of the guiding space 113 of the housing 10 to make the pawl 232 engage the gear 221 of the driving stem 22. Under this circumstance, the driving tool can drive the cylindrical member 21 and the driving stem 22 to rotate counterclockwise because the gear 221 of the driving stem 22 can push the pawl 232 when rotating to make the pawl 232 slip and press the compression spring 231. A rotation angle of the housing 10 relative to the ratchet mechanism 20 is limited by the positioning blocks 13 of the housing 10 received in the curved grooves 215 of the cylinder member 21 of the ratchet mechanism 20. Therefore, users can rotate the housing 10 to let either pawl 232,234 engage with the gear 221 of the shaft 22 and the ratchet tool can control a fastener to a desired rotation direction.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A ratchet tool comprising:

a housing including an annular sidewall having an internal surface;

a closed bottom;

an open top;

a chamber defined between the annular sidewall, the closed bottom and the open top; and multiple locking grooves formed in the internal surface of the annular sidewall and the open top;

a ratchet mechanism mounted through the housing and including a cylindrical member rotatably received in the housing and having a base received in the chamber of the housing and having an upper surface and a height being less than a height of the chamber of the housing; and a shaft formed on and protruding from the upper surface of the base;

a driving stem secured to the base of the cylindrical member; and a clutch assembly mounted in the base of the cylindrical member adjacent to the driving stem; and a locking plate mounted in the chamber of the housing and having a central hole mounted around the shaft of the cylindrical member of the ratchet mechanism;

multiple wings protruding from a periphery of the locking plate and corresponding to and engaging the locking grooves of the housing; and a height being less than a difference in height between the chamber of the housing and the base of the cylindrical member of the ratchet mechanism.

2. The ratchet tool as claimed in claim 1, wherein each locking groove of the housing has a longitudinal slot;

a lateral slot extending from a bottom of the longitudinal slot so as to form a barrier segment over the lateral slot; and a protrusion formed on and protruding from a groove surface of the lateral slot; and the locking plate further has multiple catching recesses formed in edges of the wings respectively and corresponding to the protrusions of the locking grooves of the housing.

3. The ratchet tool as claimed in claim 2, wherein the protrusions of the locking grooves of the housing are curved and convex and the catching recesses of the locking plate are curved and concave.

4. The ratchet tool as claimed in claim 3, wherein the housing further includes a through hole formed through the closed bottom and communicating with the chamber;

a guiding space formed in an upper surface of the closed bottom, communicating with the through hole and having two abutting ends; and multiple depressions formed in the internal surface of the annular sidewall at intervals;

the driving stem of the cylindrical member of the ratchet mechanism is mounted through the through hole of the housing and has a gear; and the cylindrical member of the ratchet mechanism further has a mounting space formed through the base for receiving the gear of the driving stem;

a receiving recess formed in a lower surface of the base and communicating with a side of the mounting space for receiving the clutch assembly, the clutch assembly having a pair of pawls biased by a compression spring to selectively engage with the gear of the driving stem and each pawl having a lever protruding from a lower surface of the pawl and slidably received in the guiding space of the housing; and a mounting orifice formed in an external surface of the base for receiving a spring-biased projection, the spring-biased projection having a spring member and a ball engaging one of the depressions of the housing.

5. The ratchet tool as claimed in claim 4, wherein the housing further includes two positioning blocks formed on and protruding from the internal surface of the annular sidewall and the depressions are formed between the positioning blocks; and the cylindrical member of the ratchet mechanism further has two curved grooves formed in the external surface of the base for receiving the positioning blocks of the housing and the mounting orifice is formed between the curved grooves.

6. The ratchet tool as claimed in claim 2, wherein the housing further includes a through hole formed through the closed bottom and communicating with the chamber;

a guiding space formed in an upper surface of the closed bottom, communicating with the through hole and having two abutting ends; and multiple depressions formed in the internal surface of the annular sidewall at intervals;

the driving stem of the cylindrical member of the ratchet mechanism is mounted through the through hole of the housing and has a gear; and the cylindrical member of the ratchet mechanism further has a mounting space formed through the base for receiving the gear of the driving stem;

a receiving recess formed in a lower surface of the base and communicating with a side of the mounting space for receiving the clutch assembly, the clutch assembly having a pair of pawls biased by a compression spring to selectively engage with the gear of the driving stem and each pawl having a lever protruding from a lower surface of the pawl and slidably received in the guiding space of the housing; and a mounting orifice formed in an external surface of the base for receiving a spring-biased projection, the spring-biased projection having a spring member and a ball engaging one of the depressions of the housing.

7. The ratchet tool as claimed in claim 6, wherein the housing further includes two positioning blocks formed on and protruding from the internal surface of the annular sidewall and the depressions are formed between the positioning blocks; and the cylindrical member of the ratchet mechanism further has two curved grooves formed in the external surface of the base for receiving the positioning blocks of the housing and the mounting orifice is formed between the curved grooves.

8. The ratchet tool as claimed in claim 1, wherein the housing further includes a through hole formed through the closed bottom and communicating with the chamber;

a guiding space formed in an upper surface of the closed bottom, communicating with the through hole and having two abutting ends; and multiple depressions formed in the internal surface of the annular sidewall at intervals;

the driving stem of the cylindrical member of the ratchet mechanism is mounted through the through hole of the housing and has a gear; and the cylindrical member of the ratchet mechanism further has a mounting space formed through the base for receiving the gear of the driving stem;

a receiving recess formed in a lower surface of the base and communicating with a side of the mounting space for receiving the clutch assembly, the clutch assembly having a pair of pawls biased by a compression spring to selectively engage with the gear of the driving stem and each pawl having a lever protruding from a lower surface of the pawl and slidably received in the guiding space of the housing; and a mounting orifice formed in an external surface of the base for receiving a spring-biased projection, the spring-biased projection having a spring member and a ball engaging one of the depressions of the housing.

9. The ratchet tool as claimed in claim 8, wherein the housing further includes two positioning blocks formed on and protruding from the internal surface of the annular sidewall and the depressions are formed between the positioning blocks; and the cylindrical member of the ratchet mechanism further has two curved grooves formed in the external surface of the base for receiving the positioning blocks of the housing and the mounting orifice is formed between the curved grooves.

* * * * *